United States Patent [19]

Davis et al.

[11] 3,979,633

[45] Sept. 7, 1976

[54] DIRECTIONAL GETTER ATTACHED TO MULTI-APERTURED MEMBER

[75] Inventors: Charles A. Davis, Auburn; Harry E. Smithgall, Seneca Falls, both of N.Y.

[73] Assignee: GTE Sylvania Incorporated, Stamford, Conn.

[22] Filed: Oct. 15, 1975

[21] Appl. No.: 622,497

Related U.S. Application Data

[63] Continuation of Ser. No. 510,118, Sept. 27, 1974, abandoned.

[52] U.S. Cl. ..... 313/481; 313/450; 313/178; 313/407

[51] Int. Cl.[2] ..... H01J 29/07; H01J 29/84; H01J 31/00

[58] Field of Search ..... 313/481, 174, 178, 450

[56] References Cited

UNITED STATES PATENTS

| | | | |
|---|---|---|---|
| 2,829,292 | 4/1958 | Krause | 313/450 |
| 3,264,510 | 8/1966 | Griffiths | 313/178 X |
| 3,334,258 | 8/1967 | Kaplan et al. | 313/178 X |
| 3,355,617 | 11/1967 | Schwartz et al. | 313/450 |
| 3,390,758 | 7/1968 | Reash et al. | 313/179 X |
| 3,792,300 | 2/1974 | Benda et al. | 313/481 |
| 3,816,788 | 6/1974 | Reach | 313/174 |

*Primary Examiner*—Robert Segal
*Attorney, Agent, or Firm*—Norman J. O'Malley; Frederick H. Rinn; Robert T. Orner

[57] ABSTRACT

An improvement for inhibiting arcing within a cathode ray tube comprises a combination including a low resistive electrical coating disposed interiorly on the forward portion of the funnel, joined with a high resistive coating disposed interiorly on the rearward portion thereof. Associated therewith are getter means having discretely shaped diffusion direction means to prevent the formation of a conductive path across the high resistive coating. The improved arc suppression combination beneficially improves the dielectric breakdown protection for both the tube and the associated circuitry.

2 Claims, 7 Drawing Figures

DIRECTIONAL GETTER ATTACHED TO MULTI-APERTURED MEMBER

CROSS REFERENCE TO RELATED APPLICATION

This application is a continuation of Ser. No. 510,118, filed Sept. 27, 1974, now abandoned.

BACKGROUND OF THE INVENTION

This invention relates to cathode ray tube construction and more particularly to an improved combination means for suppressing deleterious arcing in the region of the electron gun assembly.

In the continuing progression of cathode ray tube technology, there has been a trend toward the utilization of higher screen potentials along with the miniaturization and compaction of associated electron gun structures encompassed within envelope neck portions of smaller diameters. Consequently, spacings between related electrode components in the electron gun structure have been reduced in keeping with design parameters. The closeness of these inter-electrode spacings in conjunction with the high voltage differentials existent within the tube, and the presence of possible contaminants, increases the possibilities of arcing within a tube structure.

It has been conventional practice in cathode ray tube construction to have a conductive coating disposed on the interior surface of the funnel portion in a manner extending from the vicinity of the screen into the forward region of the neck portion. This coating, which usually has a high positive electrical potential applied thereto via connective means through the funnel wall, serves as a connective medium conveying a high potential of substantially the same value to both the screen and the terminal electrode of the electron gun assembly oriented in the neck portion of the tube. Thus, the condition is present for the possibility of a spark discharge between the terminal electrode and the adjacent lower voltage electrodes in the gun assembly, especially in the presence of aggravating elements such as sublimation deposits, foreign particles, and minute projections extending into the inter-electrode spacings. While considerable effort is expended during tube manufacturing to minimize the factors contributing to arcing, the utilization of anode potentials in the order of 30 KV and higher makes the possible presence of minute arcing conditions factors of extreme importance. Arcing or dielectric breakdown within the cathode ray tube has always been an undesired probability and has been found to exhibit destructive intensities of 100 amperes or more. With increased employment of solid state components in television and allied display devices, arcing within the cathode ray tube can produce catastrophic effects on the components in the operating circuitry. Additionally, an arc discharge may damage the internal structure in the tube and sublimate deleterious metallic deposits in the region of the gun structure.

Cleanliness, precision, and care in the manufacturing process are ever-continuing procedures to combat the materializing of conditions conducive for arcing. Nevertheless, human factors, processing sublimates and manufacturing tolerances sometimes combine to produce the undesirable situation. The discrete use of high resistance coatings on interior areas of the funnel has been tried. For example, one such technique is that disclosed by A. V. de Vere Krause in U.S. Pat. No. 2,829,292, wherein a band of resistive coating was internally applied to substantially the juncture region of the funnel and neck portions of the tube envelope to provide a high resistance area to limit the spark discharge current in the region of the electron gun. However, it was found that getter and other sublimation deposits within the tube tended to bridge the resistance coating thereby decreasing the intended benefit. Additionally, particles of the resistive coating tended to loosen upon insertion and placement of the electron gun. Since the minimization of arcing in present-day color cathode ray tubes is assuming ever increasing importance, it is a prime concern in tube manufacturing to achieve an expedient means for adequately controlling the arcing environment within the cathode ray tube per se.

OBJECTS AND SUMMARY OF THE INVENTION

It is an object of this invention to reduce and obviate the aforementioned disadvantages that have been evidenced in the prior art. Another object of the invention is to provide improved means for effecting improved internal arc suppression within the cathode ray tube. It is a further object of the invention to achieve the improved internal arc suppression in an expeditious and economical manner during tube manufacturing.

These and other objects and related advantages are achieved in one aspect of the invention wherein an improvement in arc suppression means within the tube envelope comprises a combination including: a low resistive electrical coating, a conjunctive high resistive electrical coating, and at least one getter element having a discretely shaped diffusion director associated therewith. The low resistive coating is of a composition similar to the conductive coating normally applied to the interior of the funnel portion, but in this instance, the low resistive coating is disposed on only substantially the forward portion of the interior surface of the funnel. By areal modification, this coating extends thereon from substantially the region adjacent the panel-funnel seal to a plane defined by substantially the rearward boundary of the conventional electrical conductive coating disposed on the exterior of the tube envelope. A second or high resistive electrical coating is uniformly and securely bonded to the interior surface of substantially the rearward portion of the funnel to provide a hard abrasive-resistant and particle-free surface thereover. The forward boundary of this high resistive coating is contiguous to the rearward boundary of the low resistive coating and extends therefrom into the neck portion to effect an electrical connection between the low resistive coating and the terminal electrode of the electron generating assembly positioned in the neck. By this combination, of coatings, a substantially common electrical potential is maintained between the low resistive coating and the terminal electrode of the electron gun thereby providing an arc suppression influence in the region of the gun. Another essential part of the combination includes at least one getter element, having a discretely shaped diffusion director integral therewith, oriented on a structural component within the tube envelope in a manner to direct the effusion of gettering material to thereby prevent the formation of a conductive path across the high resistive coating. Thus, there is provided an improved arc suppression combination which beneficially increases the dielectric breakdown protection for both the tube and the vulnerable associated circuitry.

DESCRIPTION OF THE PREFERRED EMBODIMENT

For a better understanding of the present invention, together with other and further objects, advantages, and capabilities thereof, reference is made to the following specification and appended claims in connection with the aforedescribed drawings.

While the invention is applicable for utilization in conventional cathode ray tubes employed in both monochrome and color television and allied image reproducing systems, for purposes of illustration, a color cathode ray tube utilizing a multi-apertured shadow mask and an in-line plural beam electron generating assembly will be described in this specification.

Figure 1:
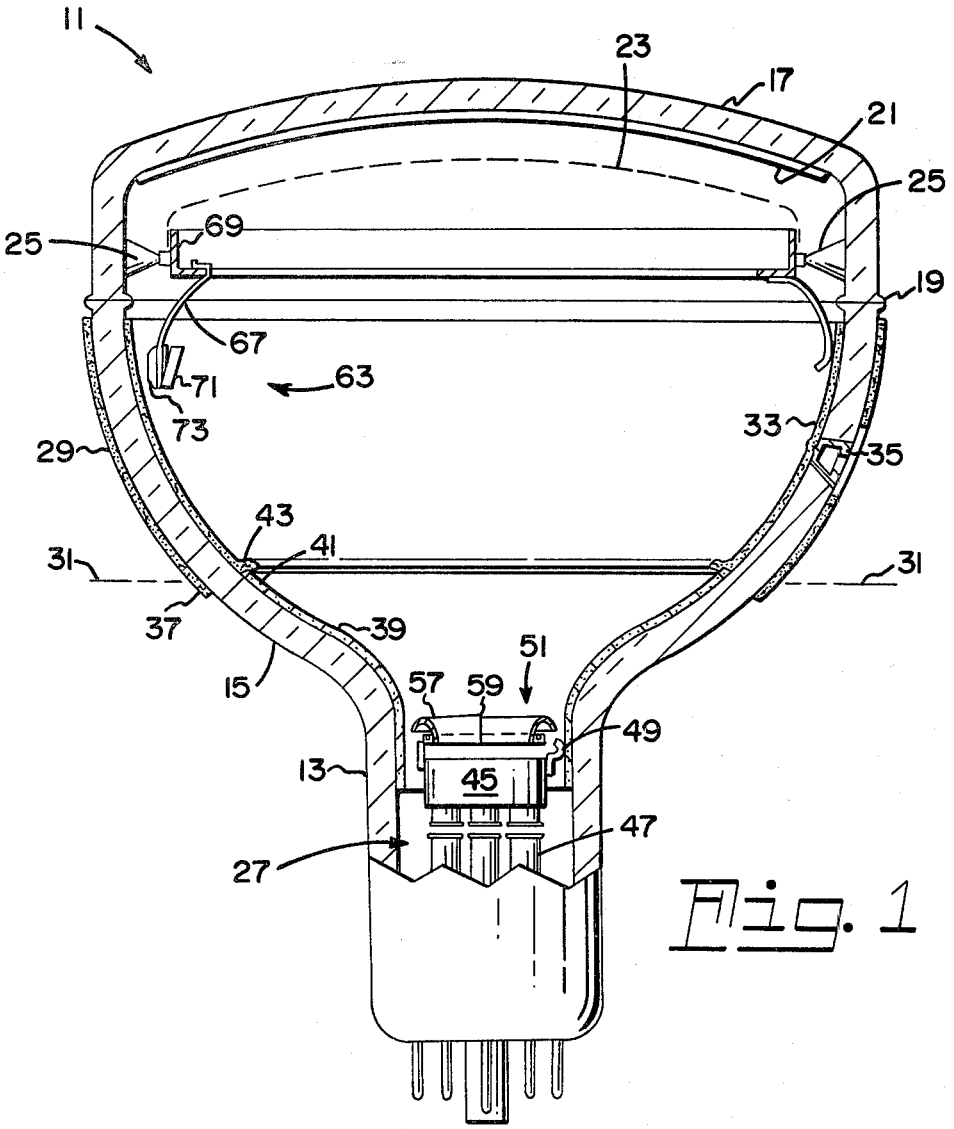
FIG. 1 is a cross-sectional view of a cathode ray tube wherein the invention is utilized.

With particular reference to FIG. 1, a plural beam color cathode ray tube construction 11 is illustrated as having an envelope comprised of an integration of neck 13, funnel 15, and face panel 17 portions; the panel and funnel portions being hermetically integrated during tube fabrication along the congruent sealing region 19. A patterned cathodoluminescent screen 21, of color-emitting phosphor areas, is disposed on the interior surface of the viewing panel 17 as an array of definitive stripes or dots, in keeping with the state of the art. A multi-apertured structure, in this instance, a shadow mask 23, having openings discretely shaped in keeping with the pattern of the screen, is oriented within the viewing panel by a plurality of locator means 25, in spatial relationship to the patterned screen.

An exemplary and partially detailed plural beam electron gun assembly 27 is positioned within the neck portion 13 of the envelope in a manner to project a plurality of electron beams to converge at the shadow mask 23 and thence impinge the patterned screen 21 therebeyond.

It has been conventional practice to dispose electrical conductive coatings on both the interior and exterior surfaces of the funnel portion. These coatings in conjunction with the intervening glass of the funnel 15 form a capacitive filtering effect which is utilized in the operational circuitry of the associated television or image display device. The exterior coating 29 on the funnel member is an electrical conductive material such as Aquadag, and is disposed on a portion of the external surface extending from substantially the region adjacent the panel-funnel seal 19 to a plane 31 substantially rearward of the mid-region of the funnel. The interiorly applied coating 33 is normally formed of a carbonaceous material, such as Aquadag, and has the electrical potential for the screen and the terminal electrode member of the electron gun assembly applied thereto by the funnel-disposed electrical transversal or button 35. As relating to this invention, the low resistive electrical coating 33, disposed on substantially the forward portion of the interior surface of the funnel, extends thereon from substantially the region adjacent the panel-funnel seal 19 to the plane 31, as defined by the rearward boundary 37 of the exteriorly disposed conductive coating 29. Continuing with the combination of the invention, a high resistive electrical coating 39 is uniformly and tenaciously bonded to the interior surface of substantially the rearward portion of the funnel 15. This coating is disposed as a skirt-like formation having a forward boundary 41 contiguous to the rearward boundary 43 of the aforementioned low resistive coating 33, and extends therefrom into the neck portion of the envelope to effect an electrical connection between the low resistive coating 33 and the terminal electrode 45 of the electron generating assembly 27. This high resistive coating 39 is comprised of a glass frit-based composition, having, for example, suitable metallic oxide inclusions, such composition being heat fused to the glass surface of the funnel to provide a hard abrasive-resistant and particle-free surface. Such resistive material, has a resistivity of, for example, $10^5$ to $10^7$ ohms per square. Thus, the extensive area of this coating 39 forms a resistive path between the conductive button 35 traversing the wall of the envelope and the terminal electrode 45 of the gun structure and exhibits a low voltage d.c. resistance value in the order of 0.5 to 10 megohms. Electrical connection with the terminal electrode is achieved, for example, by a plurality of resilient snubber means 49, one of which is shown. It has been found that resistances of this magnitude markedly limit the current and inhibit the initiation of arcs. In tubes employing the combination of this invention, peak arcing currents seldom exceed 0.5 to 1.0 amperes. In a typical electron gun assembly the high positive voltage of the anode or terminal electrode 45 may be of a potential in the order of 30 KV or more, applied via connective means 35, while the voltage on the adjacent focusing electrode 47 in the gun assembly is within the range of about 17 to 20 percent of the anode voltage. Thus, it is highly desirable to employ current limiting and arc inhibiting means in the region of the gun assembly 27.

Figure 2:
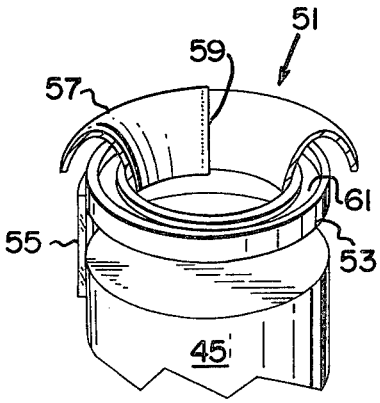
FIGS. 2 and 3 are enlarged perspectives of the tube getter embodiments illustrated in the combination shown in FIG. 1.

Another important elemental link in the improved arc suppression combination of the invention is the utilization of getter means having a discretely shaped diffusion director integral therewith and oriented on a component structure within the tube envelope to discretely direct the effusion of getter material in a manner to prevent the formation of a conductive path across the high resistive coating 39. An exemplary getter embodiment 51 is illustrated in FIGS. 1 and 2, wherein the getter element 53 is a substantially ring-shaped open-channel structure which is positioned on the forward portion of the electron generating assembly 27 by support means 55. A diffusion director 57 is a circumferential member integrally associated in a continuous manner with the inner periphery of the channel ring, extending therefrom in an outward arcuate umbrella-like encompassing manner to provide directional dispersion of the getter effusion, emanating from the channel, into the neck region. Since the diffusion or activation of the getter material is normally effected by induction heating, it has been found beneficial to provide the diffusion director 57 with at least one perimetrical substantially overlapping discontinuity 59 to prevent RF coupling and excessive heating of the director during getter activation. In FIG. 2, the circumferential diffusion director 57 is partially cut away to reveal the channelized ring 53 wherein the gettering composition 61 is initially embedded. Since the plurality of electron beams are projected through this ring-like structure 51, it is important that the getter and conjunctive director be accurately positioned on the end of the electron gun assembly 27 in a manner not to obstruct the passage of the beams therethrough.

Figure 3:
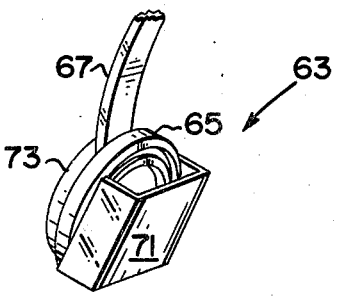

An additional getter embodiment 63 is shown in FIG. 1 and further delineated in FIG. 3. This getter embodiment is a closed-loop open-channel structure 65 which is oriented by positioning means 67 on a peripheral portion of the framing member 69 of the multi-apertured shadow mask 23, whereof the getter structure is oriented to disperse the getter effusion toward the interior of the funnel in the region of the mask. The diffusion director 71 associated therewith is in the form of a leaf-like shield member formed to provide front and side shielding means; the shielding member being attached to substantially the side of the open getter channel in a manner to extend angularly across the open face of the getter and shield the major portion of the channel and direct the effusion therefrom through an opening toward substantially the apertured member and the panel area, and away from the high resistive coating area 39. Preferably this getter element 63 has a closed backing member 73 of insulative material, such as ceramic, to prevent rearward deflection of the getter effusion toward the sidewall of the funnel. It is recognized that circular thermal barriers of materials, such as mica or glass, attached as a backing member to annular getter elements is known in the art, such being disclosed by A. J. King in U.S. Pat. No. 3,420,593.

Figure 4:
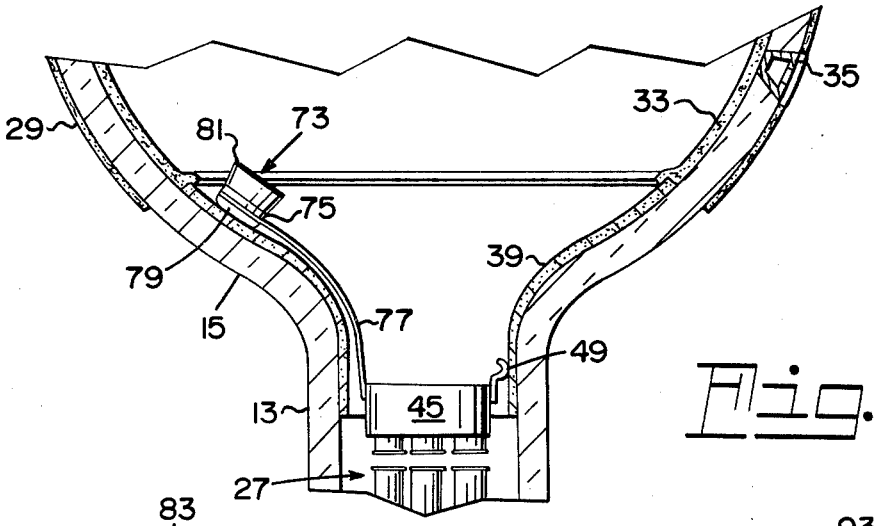
FIGS. 4 and 5 are cross-sectional and perspective illustrations detailing another getter embodiment utilized in the invention.
Figure 5:
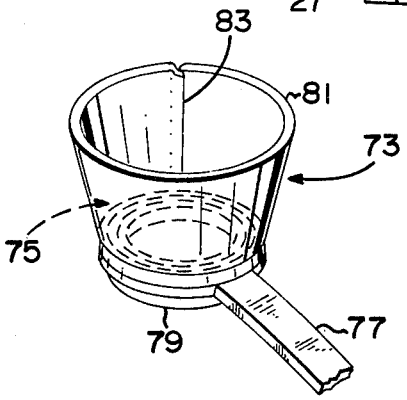
Figure 7:
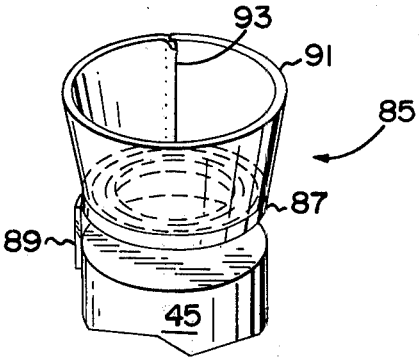
FIGS. 6 and 7 are sectional and perspective delineations of still another getter embodiment utilized in the combination of the invention.
Figure 6:
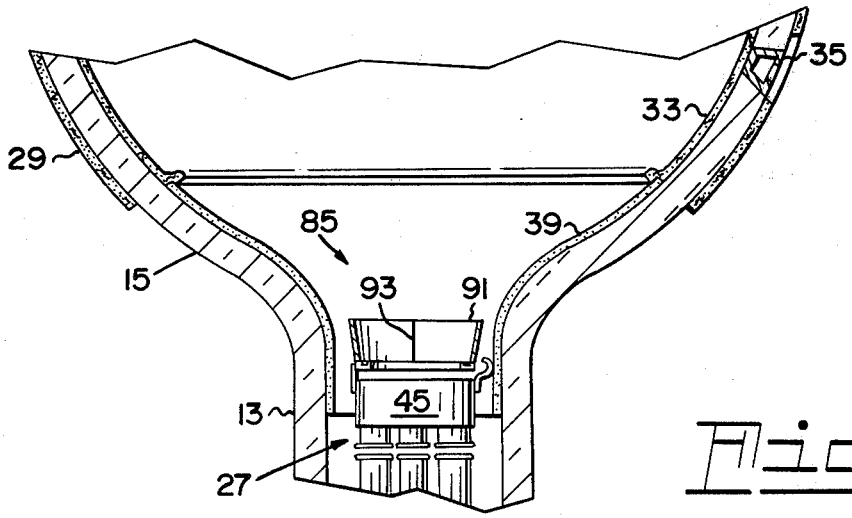

FIGS. 4 and 5 illustrate another getter embodiment 73 utilized in the improved arc suppression combination of the invention, wherein the getter element is a closed-loop open-channel structure 75 positioned forward of the electron generating assembly 27 by an arcuate longitudinal resilient support member or wand 77 affixed to the forward portion of the terminal electrode 45 of that assembly to orient the getter element 75 relative to the funnel sidewall. The getter element 75 has an insulative member 79 associated with the back thereof in a manner to make contact with one of the coatings disposed on the interior of the funnel. As shown, the getter element makes contact with the high resistive coating 39, but with the usage of a longer support member 77, contact may be made with the low resistive coating 33. The insulative backing 79 on the getter prevents the high resistive coating 39 from being shorted out by the metallic getter support member and precludes rearward deposition of the effused getter material on the adjacent funnel coating. Closed-loop channelized getters having insulative backing members are known in the art, such being disclosed by C. W. Reash et al in U.S. Pat. No. 3,390,758.

As used in this invention, the getter 75 has a diffusion director 81 which is integral with the outer periphery of the channel ring as an encompassing wall extending therefrom to provide directional dispersion of the getter effusion in a manner substantially toward the panel and away from the funnel-disposed high resistive coating. In this embodiment 73, it has been found beneficial to have at least one perimetrical overlapping discontinuity 93 to deter excessive RF heating during activation of the getter material. The positioning of this getter embodiment 85 is critical in that it should not interfere with the plurality of electron beams projected therethrough.

Thus, there is provided improved means for effecting internal arc suppression within a cathode ray tube, such being accomplished in an expeditious and economical manner during tube manufacturing. The arc suppression improvement afforded by the invention provides beneficial protection for both the tube and associated operational circuitry.

While there has been shown and described what are at present considered the preferred embodiments of the invention, it will be obvious to those skilled in the art that various changes and modifications may be made therein without departing from the scope of the invention as defined by the appended claims.

What is claimed is:

1. Means for effecting improved internal arc suppression in a cathode ray tube having an envelope formed of a sealed integration of neck, funnel and panel portions providing an enclosure for structural components including a multi-electrode electron generating assembly located in said neck portion in a manner to project at least one electron beam to traverse a multi-apertured member and impinge a cathodoluminescent screen disposed on the interior surface of said panel, the funnel portion having a low resistive electrical conductive coating disposed on the forward portion of the interior surface thereof and a high resistive electrical conductive coating interiorly disposed rearward therefrom to effect a substantially common electrical potential between the low resistive coating and the electron generating assembly while limiting the current and providing an arc suppression influence in the region of the electron generating assembly, said arc suppression improvement comprising: at least one getter element formed of a closed-loop open-channel structure positioned on a peripheral portion of said apertured member and oriented to disperse the getter effusion toward the interior of the funnel, said at least one getter element having a diffusion director in the form of a leaf-like shield attached substantially to one side of the open getter channel in a manner to angularly shield the channel and direct the effusion therefrom toward substantially the apertured member and panel area, said getter element having a backing member to prevent rearward effusion of said getter material toward the coated sidewall of the funnel.

2. The gettering improvement in a cathode ray tube according to claim 1 wherein said diffusion director is oriented in an angularly and spatially related manner across the open face of the getter to provide front and side shielding means thereto.

* * * * *